US010712095B2

(12) United States Patent
Uselton

(10) Patent No.: US 10,712,095 B2
(45) Date of Patent: Jul. 14, 2020

(54) HEAT EXCHANGER CONSTRUCTION

(71) Applicant: Lennox Industries Inc., Richardson, TX (US)

(72) Inventor: Robert B. Uselton, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 114 days.

(21) Appl. No.: 15/896,189

(22) Filed: Feb. 14, 2018

(65) Prior Publication Data

US 2019/0249924 A1 Aug. 15, 2019

(51) Int. Cl.

| | |
|---|---|
| ***F28D 1/04*** | (2006.01) |
| ***F28D 1/053*** | (2006.01) |
| ***F28F 9/02*** | (2006.01) |
| ***F24F 1/0007*** | (2019.01) |
| ***F25B 39/04*** | (2006.01) |
| ***F24F 1/0059*** | (2019.01) |
| ***F25B 39/02*** | (2006.01) |

(52) U.S. Cl.

CPC ..... *F28D 1/0417* (2013.01); *F24F 1/0007* (2013.01); *F24F 1/0059* (2013.01); *F25B 39/02* (2013.01); *F25B 39/04* (2013.01); *F28D 1/05325* (2013.01); *F28D 1/05341* (2013.01); *F28D 1/05391* (2013.01); *F28F 9/0207* (2013.01); *F28F 9/0246* (2013.01)

(58) Field of Classification Search

CPC .. F28D 1/0417; F28D 1/05391; F28F 9/0246; F24F 1/007; F24F 1/0059; F25B 39/02

See application file for complete search history.

(56) References Cited

U.S. PATENT DOCUMENTS 6,021,846 A * 2/2000 Sasaki ..... F28D 1/0417 165/144
8,166,776 B2 * 5/2012 Kopko ..... F25B 39/04 62/186
2003/0209344 A1 * 11/2003 Fang ..... F28D 1/0443 165/140

(Continued)

FOREIGN PATENT DOCUMENTS

CH 320889 A 4/1957
CN 206399232 U 8/2017

OTHER PUBLICATIONS

[Samsung VRF Single] Duct S FME(Flat Micro channel Evaporator) (EN), <https://www.youtube.com/watch?v=bKYoubDKCCs> YouTube video, published Jun. 13, 2014.

*Primary Examiner* — Elizabeth J Martin
(74) *Attorney, Agent, or Firm* — Winstead PC

(57) ABSTRACT

A heat exchanger includes a plurality of conduits that extend between a first endplate and a second endplate. A first manifold is coupled to the first endplate to couple the first manifold to first ends of the plurality of conduits. An inlet is coupled to the first manifold to direct a first fluid into the first manifold and at least one baffle is disposed within the first manifold to form a first cavity and a second cavity. The at least one baffle of the first manifold is configured to direct the first fluid from the inlet to a first conduit of the plurality of conduits. A second manifold is coupled to the second endplate to couple the second manifold to second ends of the plurality of conduits and at least one baffle is disposed within the second manifold to form a fourth cavity and a fifth cavity.

18 Claims, 6 Drawing Sheets

(56) References Cited

U.S. PATENT DOCUMENTS

| | | | | |
|---|---|---|---|---|
| 2007/0256823 | A1* | 11/2007 | Molt | F28D 1/0535 165/175 |
| 2013/0220584 | A1* | 8/2013 | Mishiro | F25B 39/00 165/143 |
| 2014/0373570 | A1 | 12/2014 | Moreau et al. | |
| 2016/0203880 | A1 | 7/2016 | Hara et al. | |
| 2016/0290730 | A1* | 10/2016 | Taras | F28D 1/0435 |

* cited by examiner

HEAT EXCHANGER CONSTRUCTION

TECHNICAL FIELD

The present invention relates generally to heat exchangers, and more particularly, but not by way of limitation, to a cross-counterflow heat exchanger for use with refrigerants.

BACKGROUND

Heating, ventilation, and air conditioning ("HVAC") systems typically include components such as, for example, a compressor, a condenser coil, an outdoor fan, an evaporator coil, and an indoor fan. The condenser coil and evaporator coil typically include a plurality of tubes or channels that are designed to exchange heat between a first fluid contained within the condenser coil or evaporator coil and a second fluid surrounding these coils. For example, the condenser coil may contain a refrigerant that has been pressurized by the compressor. The compressed refrigerant passes through the condenser coil in order to reject heat within the compressed refrigerant to ambient air passing over the condenser coil. The evaporator coil may contain a refrigerant that has been depressurized by, for example, an expansion valve in order to provide a cooling duty. The depressurized refrigerant passes through the evaporator coil to absorb heat from air passing over the evaporator coil.

In some HVAC systems, the compressor operates to significantly compress the refrigerant. The resulting pressure requires that the condenser coil and evaporator coil be constructed to reliably handle these pressures. While current coil construction methods have shown to be capable of performing as needed, the current coil construction methods have limitations. For example, the current coil construction methods do not permit a cross-counterflow arrangement for exchanging heat between a refrigerant and a surrounding air flow. The typical construction can also be costly.

SUMMARY

In an embodiment, a heat exchanger includes a plurality of conduits that extend between a first endplate and a second endplate. A first manifold is coupled to the first endplate to couple the first manifold to first ends of the plurality of conduits. An inlet is coupled to the first manifold to direct a first fluid into the first manifold and at least one baffle is disposed within the first manifold to form a first cavity and a second cavity. The at least one baffle of the first manifold is configured to direct the first fluid from the inlet to a first conduit of the plurality of conduits. A second manifold is coupled to the second endplate to couple the second manifold to second ends of the plurality of conduits and at least one baffle is disposed within the second manifold to form a fourth cavity and a fifth cavity. The at least one baffle of the second manifold is configured to direct the first fluid from the first conduit to a second conduit of the plurality of conduits. The first conduit is coupled to the first cavity of the first manifold and the fourth cavity of the second manifold and the second conduit is coupled to the fourth cavity of the second manifold and the second cavity of the first manifold.

A method of making a heat exchanger includes coupling a plurality of conduits between a first endplate and a second endplate, the plurality of conduits forming a first array of conduit ends on the first endplate and a second array of conduit ends on the second endplate. The method also includes coupling a first manifold comprising at least one baffle to the first endplate and coupling a second manifold comprising at least one baffle to the second endplate. The at least one baffle of the first manifold divides the first array of conduit ends between at least a first cavity and a second cavity, and the at least one baffle of the second manifold divides the second array of conduit ends between at least a fourth cavity and a fifth cavity.

In an embodiment, an HVAC system includes an indoor unit that includes an evaporator coil and an outdoor unit that includes a condenser coil. At least one of the evaporator coil and the condenser coil includes: a plurality of conduits that extend between a first endplate and a second endplate; a first manifold coupled to the first endplate to couple the first manifold to first ends of the plurality of conduits; an inlet coupled to the first manifold to direct a first fluid into the first manifold; at least one baffle disposed within the first manifold to form a first cavity and a second cavity and configured to direct the fluid from the inlet to a first conduit of the plurality of conduits; a second manifold coupled to the second endplate to couple the second manifold to second ends of the plurality of conduits; and at least one baffle disposed within the second manifold to form a fourth cavity and a fifth cavity and configured to direct the first fluid from the first conduit to a second conduit of the plurality of conduits. The first conduit is coupled to the first cavity of the first manifold and the fourth cavity of the second manifold, and the second conduit is coupled to the fourth cavity of the second manifold and the second cavity of the first manifold.

BRIEF DESCRIPTION OF THE DRAWINGS

A more complete understanding of embodiments of the present invention may be obtained by reference to the following Detailed Description when taken in conjunction with the accompanying Drawings wherein.

DETAILED DESCRIPTION

Embodiment(s) of the invention will now be described more fully with reference to the accompanying Drawings. The invention may, however, be embodied in many different forms and should not be construed as limited to the embodiment(s) set forth herein. The invention should only be considered limited by the claims as they now exist and the equivalents thereof.

Figure 1:
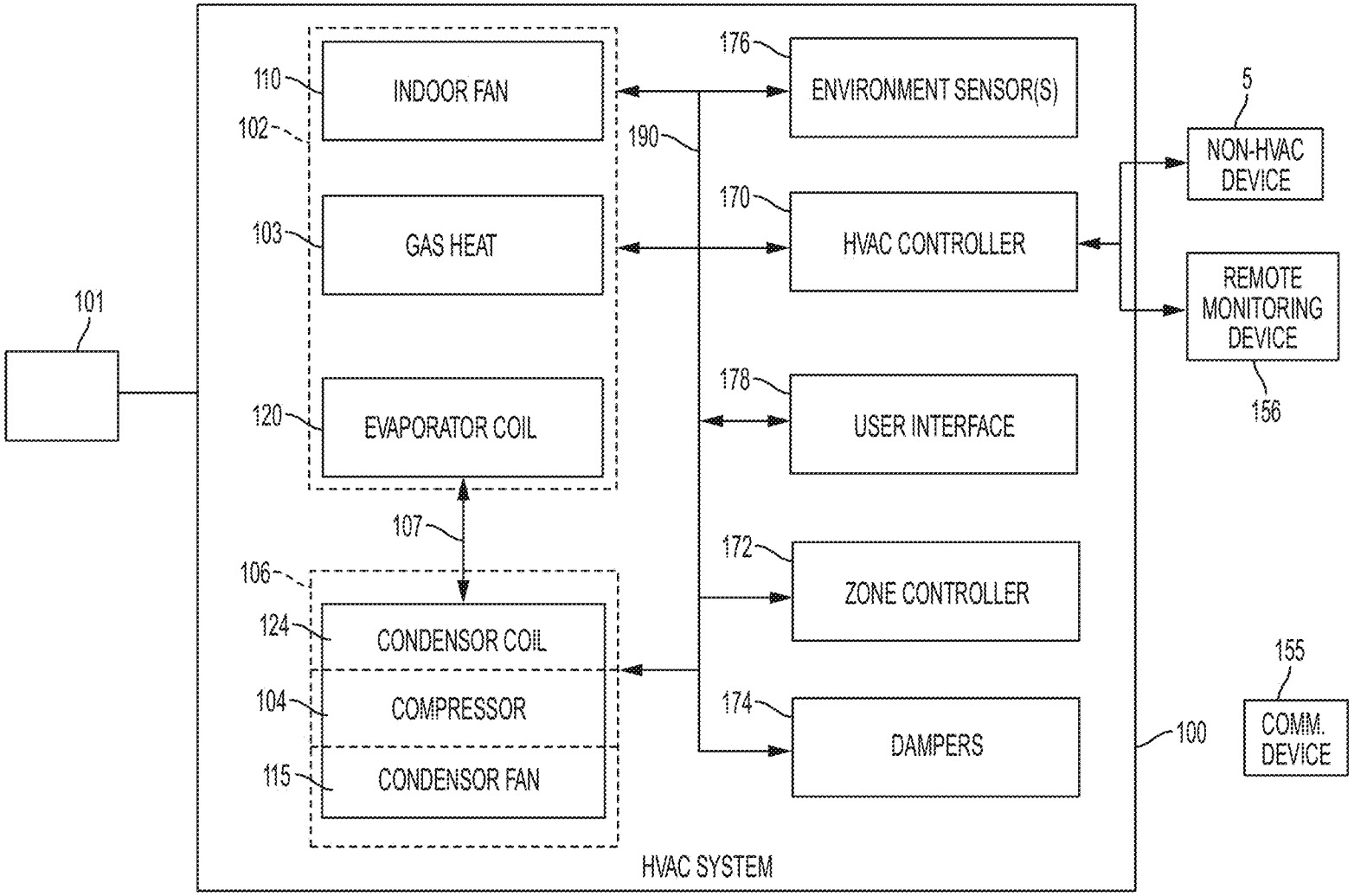
FIG. 1 is a block diagram of an illustrative AC system.

FIG. 1 illustrates an HVAC system 100. In a typical embodiment, the HVAC system 100 is a networked HVAC system that is configured to condition air via, for example, heating, cooling, humidifying, or dehumidifying air within an enclosed space 101. In a typical embodiment, the enclosed space 101 is, for example, a house, an office building, a warehouse, and the like. Thus, the HVAC system 100 can be a residential system or a commercial system such as, for example, a rooftop system. The HVAC system 100 includes various components; however, in other embodiments, the HVAC system 100 may include additional components that are not illustrated but typically included within HVAC systems.

The HVAC system 100 includes an indoor fan 110, a gas heat 103 typically associated with the indoor fan 110, and an evaporator coil 120, also typically associated with the indoor fan 110. The indoor fan 110, the gas heat 103, and the evaporator coil 120 are collectively referred to as an indoor unit 102. In a typical embodiment, the indoor unit 102 is located within, or in close proximity to, the enclosed space 101. The HVAC system 100 also includes a compressor 104, an associated condenser coil 124, and an associated condenser fan 115, which are collectively referred to as an outdoor unit 106. In various embodiments, the outdoor unit 106 and the indoor unit 102 are, for example, a rooftop unit or a ground-level unit. The compressor 104 and the associated condenser coil 124 are connected to the evaporator coil 120 by a refrigerant line 107. In a typical embodiment, the refrigerant line 107 includes a plurality of copper pipes that connect the associated condenser coil 124 and the compressor 104 to the evaporator coil 120. In a typical embodiment, the compressor 104 may be, for example, a single-stage compressor, a multi-stage compressor, a single-speed compressor, or a variable-speed compressor. The indoor fan 110, sometimes referred to as a blower, is configured to operate at different capacities (e.g., variable motor speeds) to circulate air through the HVAC system 100, whereby the circulated air is conditioned and supplied to the enclosed space 101, Still referring to FIG. 1, the HVAC system 100 includes an HVAC controller 170 that is configured to control operation of the various components of the HVAC system 100 such as, for example, the indoor fan 110, the gas heat 103, and the compressor 104 to regulate the environment of the enclosed space 101. In some embodiments, the HVAC system 100 can be a zoned system. The HVAC system 100 includes a zone controller 172, dampers 174, and a plurality of environment sensors 176. In a typical embodiment, the HVAC controller 170 cooperates with the zone controller 172 and the dampers 174 to regulate the environment of the enclosed space 101.

The HVAC controller 170 may be an integrated controller or a distributed controller that directs operation of the HVAC system 100. In a typical embodiment, the HVAC controller 170 includes an interface to receive, for example, thermostat calls, temperature setpoints, blower control signals, environmental conditions, and operating mode status for various zones of the HVAC system 100. The environmental conditions may include indoor temperature and relative humidity of the enclosed space 101. In a typical embodiment, the HVAC controller 170 also includes a processor and a memory to direct operation of the HVAC system 100 including, for example, a speed of the indoor fan 110.

Still referring to FIG. 1, in some embodiments, the plurality of environment sensors 176 are associated with the HVAC controller 170 and also optionally associated with a user interface 178. The plurality of environment sensors 176 provides environmental information within a zone or zones of the enclosed space 101 such as, for example, temperature and humidity of the enclosed space 101 to the HVAC controller 170. The plurality of environment sensors 176 may also send the environmental information to a display of the user interface 178. In some embodiments, the user interface 178 provides additional functions such as, for example, operational, diagnostic, status message display, and a visual interface that allows at least one of an installer, a user, a support entity, and a service provider to perform actions with respect to the HVAC system 100. In some embodiments, the user interface 178 is, for example, a thermostat. In other embodiments, the user interface 178 is associated with at least one sensor of the plurality of environment sensors 176 to determine the environmental condition information and communicate that information to the user. The user interface 178 may also include a display, buttons, a microphone, a speaker, or other components to communicate with the user. Additionally, the user interface 178 may include a processor and memory configured to receive user-determined parameters such as, for example, a relative humidity of the enclosed space 101 and to calculate operational parameters of the HVAC system 100 as disclosed herein.

The HVAC system 100 is configured to communicate with a plurality of devices such as, for example, a monitoring device 156, a communication device 155, and the like. In a typical embodiment, and as shown in FIG. 1, the monitoring device 156 is riot part of the HVAC system 100. For example, the monitoring device 156 is a server or computer of a third party such as, for example, a manufacturer, a support entity, a service provider, and the like. In some embodiments, the monitoring device 156 is located at an office of, for example, the manufacturer, the support entity, the service provider, and the like.

In a typical embodiment, the communication device 155 is a non-HVAC device having a primary function that is not associated with HVAC systems. For example, non-HVAC devices include mobile-computing devices configured to interact with the HVAC system 100 to monitor and modify at least some of the operating parameters of the HVAC system 100. Mobile computing devices may be, for example, a personal computer (e.g., desktop or laptop), a tablet computer, a mobile device (e.g., smart phone or smart watch), and the like. In a typical embodiment, the communication device 155 includes at least one processor, memory, and a user interface such as a display. One skilled in the art will also understand that the communication device 155 disclosed herein includes other components that are typically included in such devices including, for example, a power supply, a communications interface, and the like.

The zone controller 172 is configured to manage movement of conditioned air to designated zones of the enclosed space 101. Each of the designated zones includes at least one conditioning or demand unit such as, for example, the user interface 178, only one instance of the user interface 178 being expressly shown in FIG. 1 such as, for example, the thermostat. The HVAC system 100 allows the user to independently control the temperature in the designated zones. In a typical embodiment, the zone controller 172 operates dampers 174 to control air flow to the zones of the enclosed space 101.

A data bus 190, which in the illustrated embodiment is a serial bus, couples various components of the HVAC system 100 together such that data is communicated therebetween. The data bus 190 may include, for example, any combination of hardware, software embedded in a computer readable medium, or encoded logic incorporated in hardware or otherwise stored. (e.g., firmware) to couple components of the HVAC system 100 to each other. As an example and not by way of limitation, the data bus 190 may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus 190 may include any number, type, or configuration of data buses 190, where appropriate. In particular embodiments, one or more data buses 190 (which may each include an address bus and a data bus) may couple the HVAC controller 170 to other components of the HVAC system 100. In other embodiments, connections between various components of the HVAC system 100 are wired. For example, conventional cable and contacts may be used to couple the HVAC controller 170 to the various components. In some embodiments, a wireless connection is employed to provide at least some of the connections between components of the HVAC system 100 such as, for example, a connection between the HVAC controller 170 and the indoor fan 110 or the plurality of environment sensors 176.

Figure 2A:
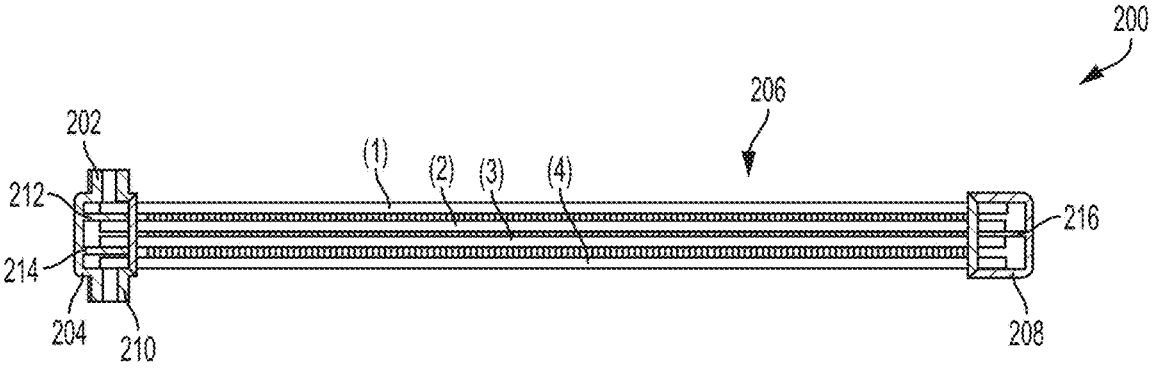
FIG. 2A is a top view of a heat exchanger.
Figure 2B:
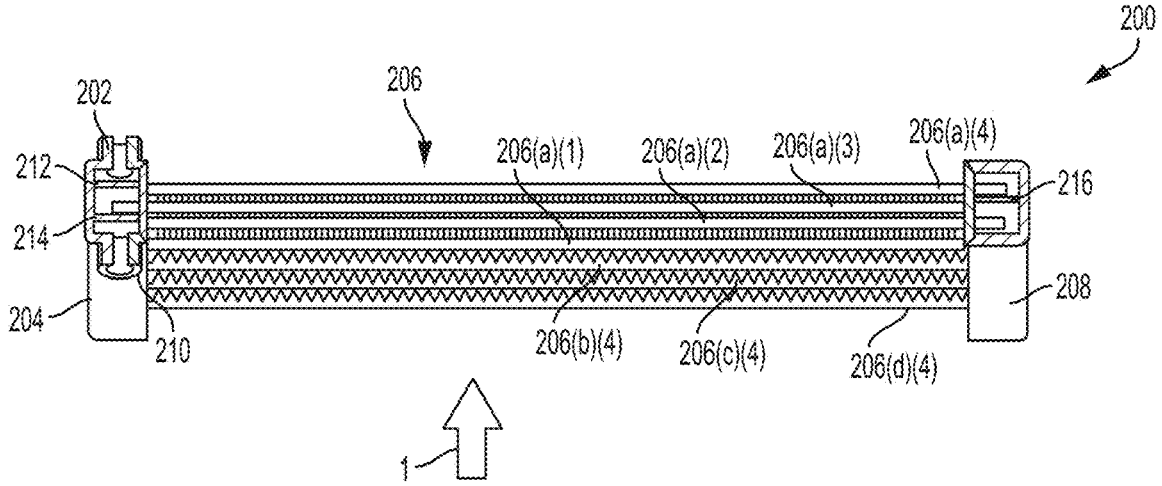
FIG. 2B is an angled view of the heat exchanger of FIG. 2A.
Figure 2C:
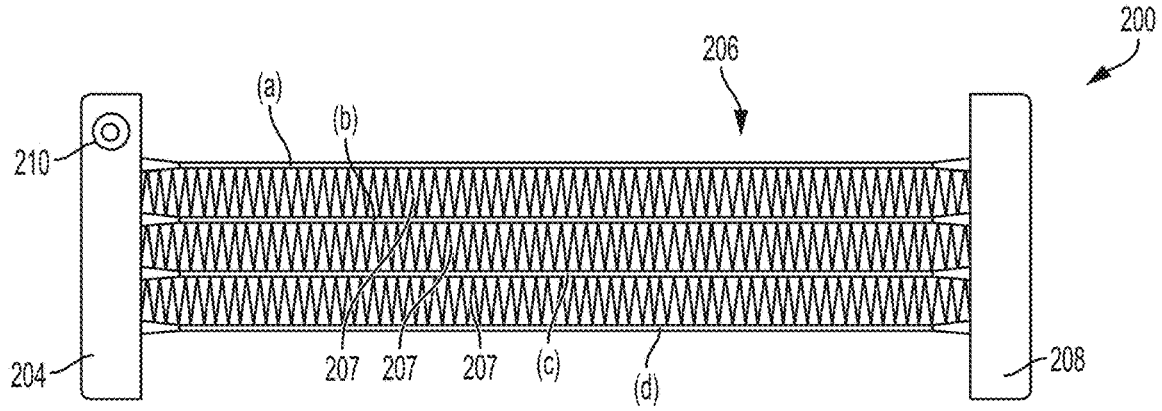
FIG. 2C is a side view of the heat exchanger of FIG. 2A.
Figure 2D:
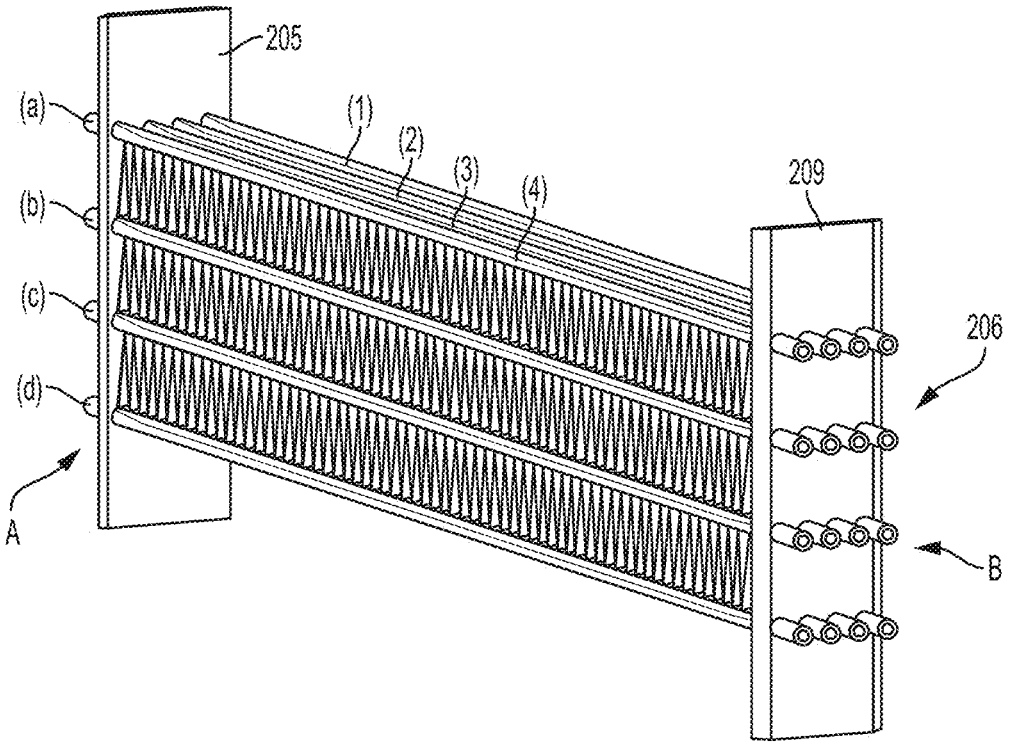
FIG. 2D is an isometric view of the heat exchanger of FIG. 2A with first and second manifolds removed.
Figure 2E:
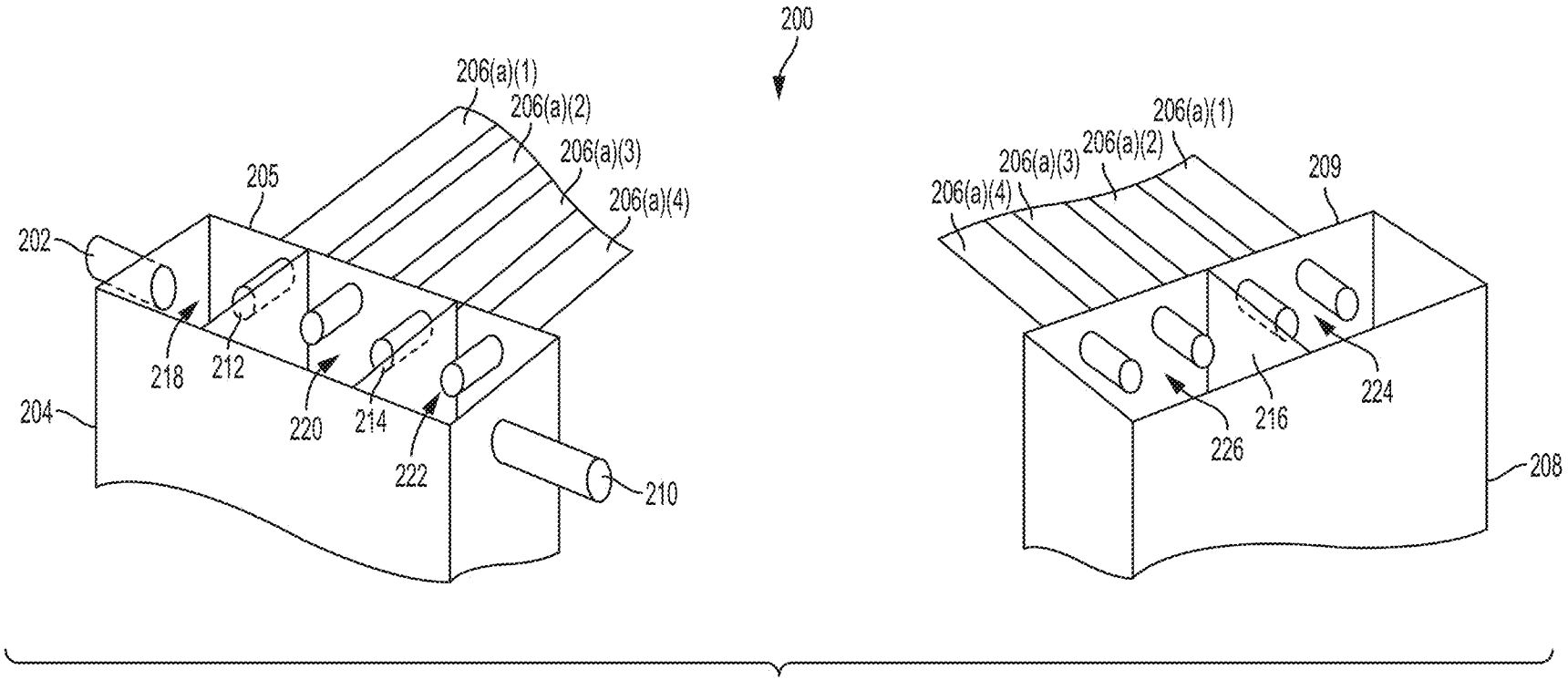
FIG. 2E is a partial close-up view of the first and second manifolds of the heat exchanger of FIG. 2A.

FIGS. 2A-2E show various views of a heat exchanger 200. FIG. 2A is a top view of the heat exchanger 200, FIG. 2B is an angled view of the heat exchanger 200, FIG. 2C is a side view of the heat exchanger 200, FIG. 2D is an isometric view of the heat exchanger 200 with first and second manifolds removed, and FIG. 2E is a partial close-up view of the first and second manifolds of the heat exchanger 200 of FIG. 2A. The heat exchanger 200 may be used as the heat exchanger in various heat exchange processes. For example, either or both of the evaporator coil 120 and the condenser coil 124 may comprise the heat exchanger 200.

Referring now to FIGS. 2A-2E, the heat exchanger 200 includes an inlet 202 that is coupled to a first manifold 204 and directs a first fluid into the first manifold 204. In a typical embodiment, the first fluid is a refrigerant. In other embodiments, the first fluid may comprise any fluid between which an exchange of heat is desired. The first manifold 204 is coupled to a first endplate 205. A plurality of conduits 206 extends between the first endplate 205 of the first manifold 204 and a second endplate 209 of a second manifold 208. First ends A of the plurality of conduits 206 are coupled to the first endplate 205 and second ends B of the plurality of conduits 206 are coupled to the second endplate 209. The first manifold 204 includes an outlet 210 that allows the first fluid to exit the heat exchanger 200 after the first fluid has passed through the plurality of conduits 206. In a typical embodiment, the first fluid enters the heat exchanger 200 through the inlet 202 and flows into the first manifold 204. The first fluid then flows through at least one conduit of the plurality of conduits 206 to the second manifold 208. The first fluid returns to the first manifold 204 via at least a second conduit of the plurality of conduits 206. In a typical embodiment, the first fluid makes multiple passes back and forth between the first manifold 204 and the second manifold 208 and then exits the heat exchanger 200 via the outlet 210. While the first fluid passes through the heat exchanger 200, a second fluid flows around the plurality of conduits 206 to exchange heat with the first fluid. In a typical embodiment, the second fluid is air. In other embodiments, the second fluid may comprise any fluid between which an exchange of heat is desired.

The first manifold 204 and the second manifold 208 function as fluid collectors and are configured to direct a flow of the first fluid as it passes through the heat exchanger 200. The first manifold 204 and the second manifold 208 may be manufactured out of a variety of materials such as, for example, plastics or metals. In embodiments using plastics, the first manifold 204 and the second manifold 208 can be created via an injection molding process or various other known processes used to form components out of plastics. Using plastic can reduce a cost to manufacture the heat exchanger 200. In some embodiments, plastics are appropriate for fluid pressures of up to approximately 175 psig. In a typical embodiment, various types of plastics may be used for the first manifold 204 and the second manifold 208 such as, for example, nylon, PVC, acetal, and PPS. When using plastic, the first manifold 204 and the second manifold 208 may be joined to the first endplate 205 and the second endplate 209, respectively, via various known joining processes such as, for example, crimping and adhesive processes. In some embodiments, a gasket may be placed between the first manifold 204 and the first endplate 205 and the second manifold 208 and second endplate 209 to provide a better seal therebetween.

In embodiments using metals, the first manifold 204 and the second manifold 208 may be formed using various known techniques such as, for example, welding, casting, pressing, and the like. In a typical embodiment, various metals may be used for the first manifold 204 and the second manifold 208 such as, for example, aluminum, copper, and steel. When the first manifold 204 and the second manifold 208 are made of metal, they may be joined to the first endplate 205 and the second endplate 209, respectively, via various known joining processes such as, for example, welding and brazing processes. In various embodiments, metals are appropriate for fluid pressures of up to approximately 300 psig.

In some embodiments, as illustrated in FIGS. 2A-2E, each conduit of the plurality of conduits 206 is a tube. In a typical embodiment, each tube of the plurality of conduits 206 is flattened resulting in increased heat transfer between the first fluid passing through the plurality of conduits 206 and a second fluid passing around the plurality of conduits 206. In a typical embodiment, the first fluid is a refrigerant and the second fluid is air. In other embodiments, the first and second fluids may comprise any fluids between which an exchange of heat is desired. In a typical embodiment, each tube of the plurality of conduits 206 is made of metal and ends of the plurality of conduits 206 are joined to the first and second endplates 205 and 209 via, for example, brazing.

The plurality of conduits 206 can be made in a variety of ways. For example, the plurality of conduits 206 can be formed via an extrusion process or by folding a sheet and welding together opposite edges of the sheet together to form a conduit. Forming the plurality of conduits 206 via folding and welding can result in lower manufacturing costs and also allows surfaces of the plurality of conduits 206 to be embossed or pressed with intricate shapes to increase a surface area of the plurality of conduits 206 that comes into contact with the first and second fluids to increase an ability of the plurality of conduits 206 to transfer heat between the first and second fluids. FIG. 3 and the related discussion below provide additional description of forming the plurality of conduits 206 via folding and welding. In some embodiments, the plurality of conduits 206 may comprise other types of conduits such as, for example, microchannels.

As illustrated in FIGS. 2A-2E, the plurality of conduits 206 comprises four layers (a)-(d) and four rows (1)-(4). The four layers (a)-(d) and four rows (1)-(4) form a first array of conduit ends at the first endplate 205 and a second array of conduit ends at the second endplate 209. For example, FIG. 2D shows each of the first array of conduit ends and the second array of conduit ends is a four by four array. The first array comprises the first ends A of the conduits 206(*a*)(1), 206(*a*)(2), 206(*a*)(3), 206(*a*)(4), 206(*b*)(1), 206(*b*)(2), 206

(*b*)(3), 206(*b*)(4), 206(*c*)(1), 206(*c*)(2), 206(*c*)(3), 206(*c*)(4), 206(*d*)(1), 206(*d*)(2), 206(*d*)(3), and 206(*d*)(4) and the second array comprises the second ends B of the same conduits. In other embodiments, arrays of different dimensions may be used.

In a typical embodiment, a plurality of fins 207 are disposed between the four layers (a)-(d) of the plurality of conduits 206. The plurality of fins 207 are configured to increase heat transfer between the second fluid that passes around the heat exchanger 200 (e.g., air) and the first fluid flowing through the heat exchanger 200 (e.g., refrigerant).

FIG. 2E shows partial close-up views of the first manifold 204 and the second manifold 208 that more clearly illustrate how layer (a) and rows (1)-(4) of the plurality of conduits 206 are connected to the first manifold 204 and the second manifold 208. Layers (b)-(d) are not shown for the sake of clarity, but are similarly connected to the first endplate 205 and the second endplate 209 beneath the layer (a). When referring to specific conduits of the plurality of conduits 206 coordinates will be used. For example, conduit 206(*a*)(1) refers to the conduit 206 in the layer (a) and the row (1). As will be appreciated by a person of ordinary skill in the art, the heat exchanger 200 can be modified to include more or fewer layers of conduits and more or fewer rows of conduits.

The first manifold 204 includes a first baffle 212 and a second baffle 214 that divide the first manifold 204 into a first cavity 218, a second cavity 220, and a third cavity 222. The second manifold 208 includes a third baffle 216 that divides the second manifold 208 into a fourth cavity 224 and a fifth cavity 226. The cavities 218, 220, 222, 224, and 226 create a flow path for the first fluid that passes back and forth between the first manifold 204 and the second manifold 208.

Referring now to FIGS. 2A-2E, a flow of the first fluid through the heat exchanger 200 is now described in detail. The first fluid enters the heat exchanger 200 via the inlet 202. The inlet 202 guides the first fluid into the first cavity 218 of the first manifold 204. The first cavity 218 is coupled to the conduits 206(*a*)(1), 206(*b*)(1), 206(*c*)(1), and 206(*d*)(1). The first baffle 212 blocks the first fluid from entering the second cavity 220 and the third cavity 222. The first cavity 218 directs the first fluid to flow through the conduits 206(*a*)(1), 206(*b*)(1), 206(*c*)(1), and 206(*d*)(1) toward the fourth cavity 224 of the second manifold 208. The third baffle 216 prevents the first fluid from the conduits 206(*a*)(1), 206(*b*)(1), 206(*c*)(1), and 206(*d*)(1) from entering the fifth cavity 226. The fourth cavity 224 directs first fluid into conduits 206(*a*)(2), 206(*b*)(2), 206(*c*)(2), and 206(*d*)(2). The conduits 206(*a*)(2), 206(*b*)(2), 206(*c*)(2), and 206(*d*)(2) direct the first fluid to the second cavity 220. The first fluid then exits the second cavity 220 via the conduits 206(*a*)(3), 206(*b*)(3), 206(*c*)(3), and 206(*d*)(3) and flows to the fifth cavity 226. The first fluid exits the fifth cavity 226 via the conduits 206(*a*)(4), 206(*b*)(4), 206(*c*)(4), and 206(*d*)(4), which direct the first fluid to the third cavity 222. The first fluid may then exit the heat exchanger 200 via the outlet 210. While the first fluid passes through the plurality of conduits 206, the second fluid is directed to flow around the plurality of conduits 206 in the direction indicated by arrow 1 in FIG. 2B. In some embodiments, the first fluid is a refrigerant and the second fluid is air. In other embodiments, the first fluid may comprise any fluid between which an exchange of heat is desired. The flow arrangement created by the design of the heat exchanger 200 is a cross-counter flow arrangement.

A person of ordinary skill in the art will recognize that each of the inlet 202 and the outlet 210 could be disposed on either the first manifold 204 or the second manifold 208 by using an appropriate number of baffles within the first manifold 204 and the second manifold 208 to direct the first fluid to pass through the plurality of conduits 206. For example, the first fluid can be made to make additional passes between the first manifold 204 and the second manifold 208 by adding additional baffles to the first manifold 204 and the second manifold 208. Similarly, fewer passes may be achieved by removing baffles from the first manifold 204 and the second manifold 208. The design of the heat exchanger 200 allows for complicated, multi-pass flow paths to be created with a simplified design as compared to other heat exchanges that require additional manifolds to create additional passes.

Figure 3B:
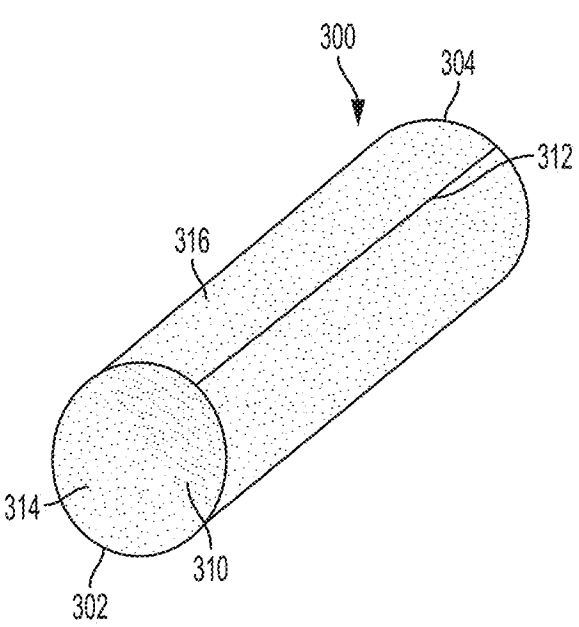
FIGS. 3A and 3B illustrate a tube-type conduit in a pre-formed and a post-formed configuration, respectively.
Figure 3A:
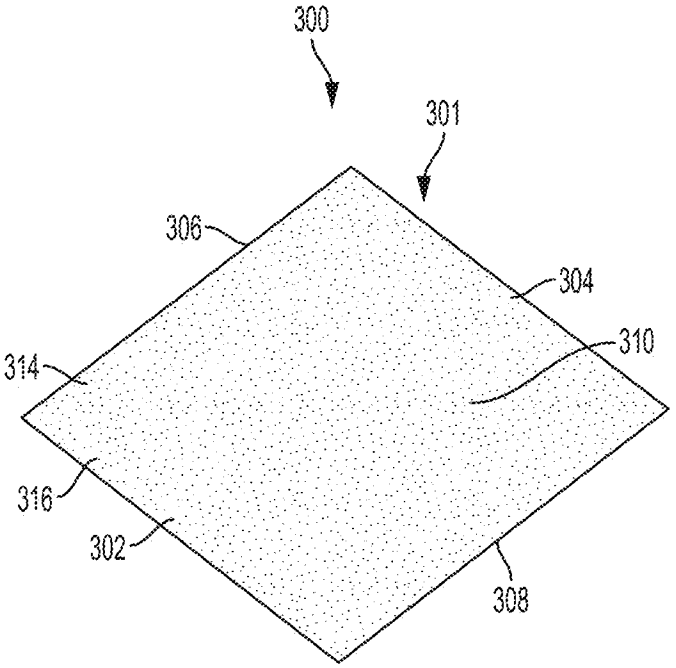

FIGS. 3A and 3B illustrate a tube-type conduit 300 in a pre-formed and post-formed configuration, respectively. The plurality of conduits 206 discussed above relative to FIGS. 2A-2E may comprise the tube-type conduit 300. FIG. 3A illustrates the tube-type conduit 300 in the pre-formed configuration. In the pre-formed configuration, the tube-type conduit 300 is a sheet 301. The sheet 301 includes a front edge 302, a back edge 304, a left side edge 306, and a right side edge 308. The sheet 301 includes a surface treatment 310 that may be applied to one or both of a first side 314 and a second side 316 of the sheet 301. The surface treatment 310 may be any of a variety of surface treatments that provides a dimensionality to the sheet 301. In a typical embodiment, the surface treatment 310 may be, for example, embossed, pressed, or etched onto the sheet 301. The surface treatment 310 may include various shapes such as, grooves, undulations, scorings, stampings, and embossings. The surface treatment 310 increases heat transfer between the first fluid passing through the tube-type conduit 300 (e.g., a refrigerant) and the second fluid passing around the tube-type conduit 300 (e.g., air) by increasing a surface area of the tube-type conduit 300 that contacts the first and second fluids.

To form the sheet 301 into a tube, the sheet 301 is folded so that the left side edge 306 and the right side edge 308 abut one another. The left side edge 306 and the right side edge 308 may then be joined together to form a tube as shown in FIG. 3B. In a typical embodiment, the sheet 301 is made of a metal and the left side edge 306 and the right side edge 308 are joined together via, for example, a weld 312. Other non-metallic materials may be used and other joining techniques may be used. The tube-type conduit 300 of FIGS. 3A and 3B is shown with the surface treatment 310 applied to the first side 314 and the second side 316. In other embodiments, the surface treatment 310 may be applied to either the first side 314 or the second side 316.

Figure 4:
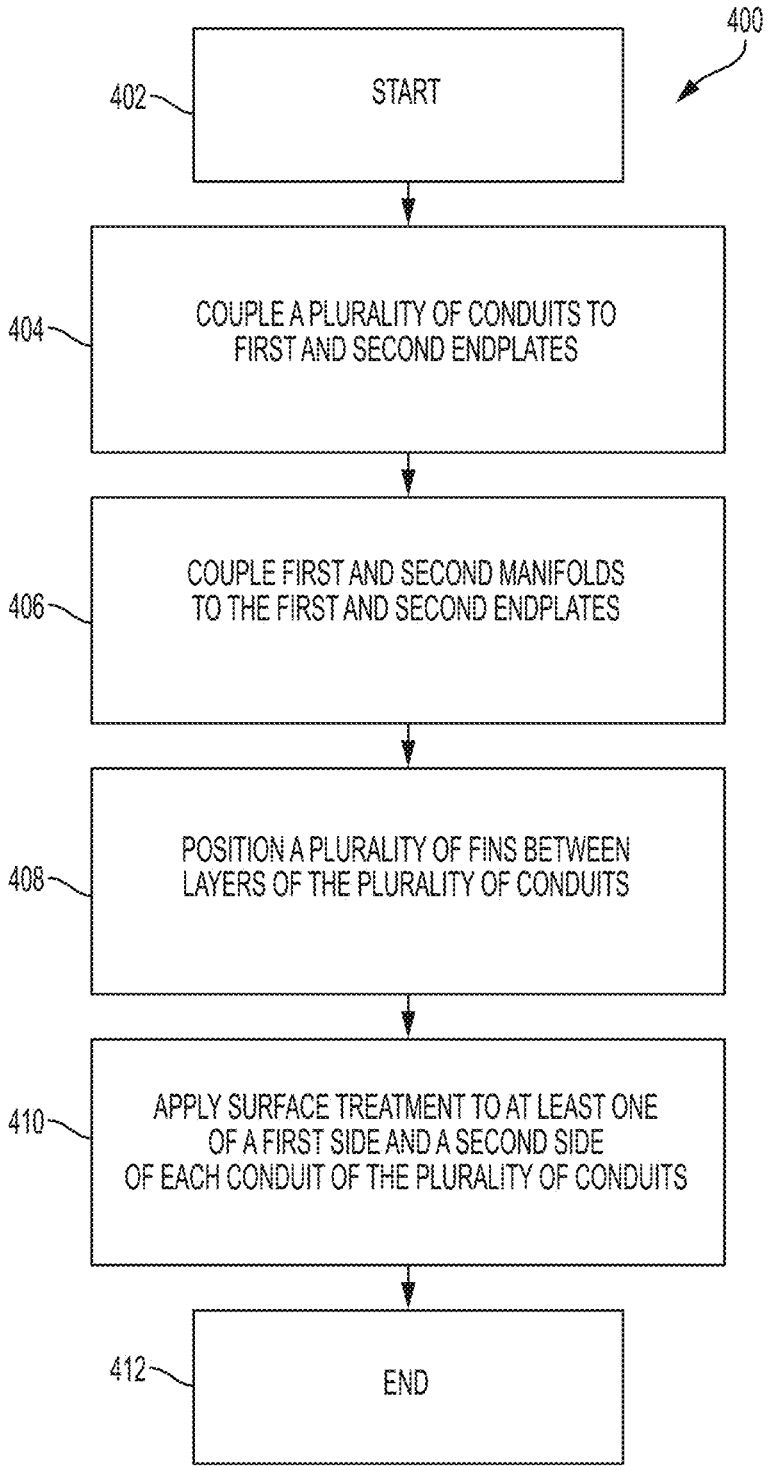
FIG. 4 is a flow diagram of a method of constructing a heat exchanger.

FIG. 4 is a flow diagram of a method 400 of constructing a heat exchanger. For purposes of illustration, the method 400 will be discussed relative to FIGS. 2A-2E and FIGS. 3A-3B. The method 400 starts at a step 402. At step 404, the plurality of conduits 206 are coupled between a first endplate 205 and a second endplate 209. The coupling of the plurality of conduits 206 to the first endplate 205 and the second endplate 209 forms a first array of conduits on the first endplate 205 and a second array of conduits on the second endplate 209. An example of an array of conduits is shown in FIG. 2D. The method 400 continues at a step 406.

At step 406, a first manifold 204 comprising at least one baffle (e.g., the first baffle 212) is coupled to the first endplate 205 and a second manifold comprising at least one baffle (e.g., the third baffle 216) is coupled to the second endplate 209. The at least one baffle of the first manifold 204 divides the first array of conduits between the first cavity 218 and the second cavity 220. The at least one baffle of the second manifold 208 divides the second array of conduits between the fourth cavity 224 and the fifth cavity 226.

The method 400 may optionally include one or more of steps 408 and 410. At step 408, the plurality of fins 207 are positioned between layers (a)-(d) of the plurality of conduits 206. The plurality of fins 207 may be positioned between the layers (a)-(d) at the same time the plurality of conduits 206 are coupled to the first endplate 205 and the second endplate 209 or after the plurality of conduits 206 have been coupled to the first endplate 205 and the second endplate 209. At step 410, a surface treatment 310 is applied to at least one of the first side 314 and the second side 316 of each conduit of the plurality of conduits 206. The surface treatment may be applied to the plurality of conduits 206 prior to the plurality of conduits 206 being coupled to the first endplate 205 and the second endplate 209. The method 400 ends at step 412.

Conditional language used herein such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

Although various embodiments of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein.

What is claimed is:

1. A heat exchanger comprising:

a plurality of conduits that extend between a first endplate and a second endplate;

a first manifold coupled to the first endplate to couple the first manifold to first ends of the plurality of conduits;

an inlet coupled to the first manifold to direct a first fluid into the first manifold;

at least one baffle disposed within the first manifold to form a first cavity and a second cavity and configured to direct the first fluid from the inlet to a first conduit of the plurality of conduits;

a second manifold coupled to the second endplate to couple the second manifold to second ends of the plurality of conduits;

at least one baffle disposed within the second manifold to form a fourth cavity and a fifth cavity and configured to direct the first fluid from the first conduit to a second conduit of the plurality of conduits;

wherein the first conduit is coupled to the first cavity of the first manifold and the fourth cavity of the second manifold and the second conduit is coupled to the fourth cavity of the second manifold and the second cavity of the first manifold; and wherein adjacent conduits of the plurality of conduits form a horizontal row such that each adjacent conduit of the horizontal row is arranged to direct flow of the first fluid in each adjacent conduit of the horizontal row in opposite directions.

2. The heat exchanger of claim 1, wherein:

the plurality of conduits comprises a first layer of conduits and a second layer of conduits disposed beneath the first layer of conduits; and the first layer of conduits comprises the first conduit and the second conduit.

3. The heat exchanger of claim 2, wherein the second layer of conduits comprises a third conduit disposed beneath the first conduit and a fourth conduit disposed beneath the second conduit.

4. The heat exchanger of claim 2, further comprising a plurality of fins disposed between the first layer of conduits and the second layer of conduits.

5. The heat exchanger of claim 1, wherein the at least one baffle disposed within the first manifold comprises a first baffle and a second baffle, the first baffle and the second baffle forming the first cavity, the second cavity, and a third cavity within the first manifold.

6. The heat exchanger of claim 5, further comprising:

a third conduit coupled to the second cavity of the first manifold and the fifth cavity of the second manifold; and a fourth conduit coupled to the fifth cavity of the second manifold and the third cavity of the first manifold.

7. The heat exchanger of claim 6, wherein:

the plurality of conduits comprises a first layer of conduits and a second layer of conduits disposed beneath the first layer of conduits; and the first layer of conduits comprises the first conduit, the second conduit, the third conduit, and the fourth conduit.

8. The heat exchanger of claim 7, further comprising a plurality of fins disposed between the first layer of conduits and the second layer of conduits.

9. The heat exchanger of claim 1, wherein each conduit of the plurality of conduits comprises a sheet that is welded along opposite edges of the sheet to form the conduit.

10. The heat exchanger of claim 9, wherein the sheet comprises a surface treatment on at least one of a first side of the sheet and a second side of the sheet.

11. The heat exchanger of claim 1, wherein at least one of a first side and a second side of each conduit of the plurality of conduits comprises a surface treatment.

12. The heat exchanger of claim 1, further comprising an outlet coupled to the first manifold that directs the first fluid out of the first manifold.

13. A method of making a heat exchanger, the method comprising:

coupling a plurality of conduits between a first endplate and a second endplate, the plurality of conduits forming a first array of conduit ends on the first endplate and a second array of conduit ends on the second endplate;

coupling a first manifold comprising at least one baffle to the first endplate and coupling a second manifold comprising at least one baffle to the second endplate;

wherein the at least one baffle of the first manifold divides the first array of conduit ends between at least a first cavity and a second cavity;

wherein the at least one baffle of the second manifold divides the second array of conduit ends between at least a fourth cavity and a fifth cavity; and wherein adjacent conduits of the plurality of conduits form a horizontal row such that each adjacent conduit of the horizontal row is arranged to direct flow of a first fluid in each adjacent conduit of the horizontal row in opposite directions.

14. The method of claim 13, further comprising positioning a plurality of fins between layers of the plurality of conduits.

15. The method of claim 13, further comprising applying a surface treatment to a surface of each conduit of the plurality of conduits.

16. The method of claim 13, wherein the first manifold comprises an inlet that directs the first fluid into the first manifold and an outlet that directs the first fluid out of the heat exchanger.

17. The method of claim 13, wherein each conduit of the plurality of conduits comprises a sheet that is welded along opposite edges of the sheet to form the conduit.

18. An HVAC system, comprising:

an indoor unit comprising an evaporator coil;

an outdoor unit comprising a condenser coil;

wherein at least one of the evaporator coil and the condenser coil comprises:

a plurality of conduits that extend between a first endplate and a second endplate;

a first manifold coupled to the first endplate to couple the first manifold to first ends of the plurality of conduits;

an inlet coupled to the first manifold to direct a first fluid into the first manifold;

at least one baffle disposed within the first manifold to form a first cavity and a second cavity and configured to direct the first fluid from the inlet to a first conduit of the plurality of conduits;

a second manifold coupled to the second endplate to couple the second manifold to second ends of the plurality of conduits; and at least one baffle disposed within the second manifold to form a fourth cavity and a fifth cavity and configured to direct the first fluid from the first conduit to a second conduit of the plurality of conduits;

wherein the first conduit is coupled to the first cavity of the first manifold and the fourth cavity of the second manifold, and the second conduit is coupled to the fourth cavity of the second manifold and the second cavity of the first manifold; and wherein adjacent conduits of the plurality of conduits form a horizontal row such that each adjacent conduit of the horizontal row is arranged to direct flow of the first fluid in each adjacent conduit of the horizontal row in opposite directions.

* * * * *